US009238157B2

(12) United States Patent
Chuang et al.

(10) Patent No.: US 9,238,157 B2
(45) Date of Patent: Jan. 19, 2016

(54) FITNESS APPARATUS

(71) Applicants: Jin-Chen Chuang, Taichung (TW); Lung-Fei Chuang, Taichung (TW)

(72) Inventors: Jin-Chen Chuang, Taichung (TW); Lung-Fei Chuang, Taichung (TW)

( * ) Notice: Subject to any disclaimer, the term of this patent is extended or adjusted under 35 U.S.C. 154(b) by 200 days.

(21) Appl. No.: 13/970,473

(22) Filed: Aug. 19, 2013

(65) Prior Publication Data

US 2014/0364288 A1 Dec. 11, 2014

(30) Foreign Application Priority Data

Jun. 7, 2013 (TW) ..... 102210791 U

(51) Int. Cl.

| | |
|---|---|
| ***A63B 21/02*** | (2006.01) |
| ***A63B 21/055*** | (2006.01) |
| ***A63B 23/02*** | (2006.01) |
| ***A63B 23/12*** | (2006.01) |
| ***A63B 21/04*** | (2006.01) |
| *A63B 21/05* | (2006.01) |
| *A63B 21/008* | (2006.01) |
| *A63B 21/00* | (2006.01) |
| *A63B 22/00* | (2006.01) |
| *A63B 23/035* | (2006.01) |

(Continued)

(52) U.S. Cl.

CPC ..... *A63B 21/055* (2013.01); *A63B 21/00069* (2013.01); *A63B 21/00181* (2013.01); *A63B 21/023* (2013.01); *A63B 21/0428* (2013.01); *A63B 21/4047* (2015.10); *A63B 23/0233* (2013.01); *A63B 23/0355* (2013.01); *A63B 23/1236* (2013.01); *A63B 21/0083* (2013.01); *A63B 21/05* (2013.01); *A63B 21/0552* (2013.01); *A63B 21/154* (2013.01); *A63B 22/0056* (2013.01); *A63B 23/03508* (2013.01); *A63B 23/03525* (2013.01); *A63B 23/03541* (2013.01); *A63B 23/0405* (2013.01); *A63B 2071/027* (2013.01)

(58) Field of Classification Search

CPC ..... A63B 21/001069; A63B 21/00181; A63B 21/023; A63B 21/025; A63B 21/0421; A63B 21/0428; A63B 21/0435; A63B 21/055; A63B 21/0552; A63B 23/0205; A63B 23/0233; A63B 23/1236; A63B 23/03525; A63B 23/03541; A63B 21/00069; A63B 21/00072; A63B 21/00076; A63B 21/04; A63B 21/0407; A63B 21/0442; A63B 21/045; A47C 9/002

USPC ..... 482/121–131, 140, 142, 905, 907

See application file for complete search history.

(56) References Cited

U.S. PATENT DOCUMENTS 3,428,312 A * 2/1969 Machen ..... 482/123
3,953,026 A * 4/1976 Stokely ..... 482/123

(Continued)

*Primary Examiner* — Oren Ginsberg
*Assistant Examiner* — Gregory Winter
(74) *Attorney, Agent, or Firm* — CKC & Partners Co., Ltd.

(57) ABSTRACT

A fitness apparatus includes a first frame, a second frame, a nose part, a linear elastic element, and a cable. The second frame is pivotally connected to the first frame. The nose part and the second frame are coaxially pivotally connected to the first frame. The linear elastic element has a first end and a second end. The first end is connected to the first frame. The cable has a connecting end and a force-applying end. The connecting end is connected to the second end. The cable is pressed against the nose part, and the force-applying end of the cable drives the second frame. When the second frame pivotally swings against the first frame, the second frame pulls the cable and changes the length of the cable pressed against the nose part, whereby the linear elastic element may be stretched or shortened by the cable.

15 Claims, 17 Drawing Sheets

(51) Int. Cl.
*A63B 23/04* (2006.01)
*A63B 71/02* (2006.01)

(56) References Cited

U.S. PATENT DOCUMENTS 4,603,857 A * 8/1986 Chipman et al. ..... 482/123
4,830,365 A * 5/1989 March ..... 482/129
5,613,927 A * 3/1997 Rothacker ..... 482/123
5,772,563 A * 6/1998 Lin ..... 482/140
6,090,023 A * 7/2000 Liu ..... 482/140
6,220,995 B1 * 4/2001 Chen ..... 482/140
6,368,261 B1 * 4/2002 Doehler ..... 482/142
6,592,500 B1 * 7/2003 McBride et al. ..... 482/140
8,764,617 B2 * 7/2014 Teeter ..... 482/126
2004/0209750 A1 * 10/2004 Parmater ..... 482/123
2007/0135281 A1 * 6/2007 Liao ..... 482/140
2007/0270294 A1 * 11/2007 Sheets ..... 482/140
2007/0281839 A1 * 12/2007 Lin et al. ..... 482/140
2007/0281840 A1 * 12/2007 Tsai ..... 482/140
2012/0184419 A1 * 7/2012 Zhu ..... 482/127
2012/0316041 A1 * 12/2012 Meister et al. ..... 482/140
2013/0095982 A1 * 4/2013 Chen ..... 482/71

* cited by examiner

FITNESS APPARATUS

RELATED APPLICATIONS

This application claims priority to Taiwan Application Serial Number 102210791, filed Jun. 7, 2013, which is herein incorporated by reference.

BACKGROUND

1. Technical Field

The present disclosure relates to a fitness apparatus. More particularly, the present disclosure relates to a fitness apparatus employing a linear elastic element, so that the fitness apparatus can be clamped and released repeatedly.

2. Description of Related Art

Modern life can be very busy and exhausting, and people are commonly suffering from chronic fatigue due to insufficient physical exercise. And some people may exercise to strengthen different muscle groups of bodies. As a result, all kinds of fitness apparatuses are invented and produced to meet people's needs on taking exercise with the fitness apparatus.

However, one fitness apparatus providing single fitness exercise can result in need of different apparatuses for strengthening different muscle groups and is space ineffective.

Therefore, a fitness apparatus with multiple functions is popular in markets. Among which, a fitness apparatus includes a clamping frame, using the repeatedly clamping-and-releasing frame to aid doing sit-ups, push-ups, or abdominal workouts, so as to achieve the purpose of single apparatus providing multiple ways of physical exercises.

Conventional clamping-frame fitness apparatus employs a torsion spring to provide the resilience force. But the torsion spring usually provides resilience force larger than the requirement, which does not suit for user with smaller physical strength. And the torsion spring is apt to be permanently deformed. When a user wants to adjust the resilience force, the user would need to replace the torsion spring with another, but adjusting resilience force is never an easy and convenient job. Therefore, this conventional clamping-frame fitness apparatus cannot meet varies needs among board users. Further, it is difficult for the users to adjust the resilience force of the torsion spring by themselves, which also limits the usability of the fitness apparatus for workout.

SUMMARY

According to the present disclosure, a fitness apparatus includes a first frame, a second frame, a nose part, a linear elastic element, and a cable. The second frame is pivotally connected to the first frame. The nose part and the second frame are coaxially pivotally connected to the first frame. The linear elastic element has a first end and a second end. The first end is connected to the first frame. The cable has a connecting end and a force-applying end. The connecting end is connected to the second end of the linear elastic element, and the cable is pressed against the nose part. The force-applying end of the cable drives the second frame. When the second frame pivotally swings against the first frame, the second frame pulls the cable and changes the length of the cable pressed against the nose part. And the linear elastic element is stretched or shortened by the cable.

In the foregoing, the first frame of the fitness apparatus can include an adjusting module. The linear elastic element can be connected to the adjusting module. The adjusting module can be configured to adjust the position of the first end of the linear elastic element. The adjusting module can include a threaded element and a screw element. The threaded element can be connected to the first end of the linear elastic element. By some embodiments, the threaded element can drive the first end. The screw element can be matched with the threaded element. In some embodiments, the screw element can be positioned at the first frame.

In the foregoing, the nose part of the fitness apparatus can have a guide part. In some embodiments, the guide part can guide and limit the cable. Or the nose part of the fitness apparatus can have a plurality of guide parts. In some embodiments, each of the plurality of guide parts can be configured to guide and limit the cable. And the length of the cable pressed against each of the plurality of the nose parts can be different. The force-applying end of the cable can be removably connected to the second frame. The second frame can have a plurality of installing parts configured to fix the force-applying end of the cable to different locations of the second frame.

In the foregoing, the fitness apparatus can further include a pulley, a blocking element, a pushing element, and a seat. The pulley can be pivotally connected to the first frame. In some embodiments, the second frame and the pulley are coaxially pivotally connected to the first frame. The blocking element can be configured to block the first end of the linear elastic element. The pushing element can be slidably connected to the first frame along a stretching direction of the linear elastic element. In some embodiments, the pushing element pushes against the second end of the linear elastic element, and the connecting end of the cable connects the second end of the linear elastic element through the pushing element. The seat can be connected to the first frame or the second frame. Furthermore, the nose part and the second frame can be structured as one-piece. The second frame can be in approximately inverted U shape. The fitness apparatus can include two independent second frames. In some embodiments, each of the two second frames can be in approximately L shape.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
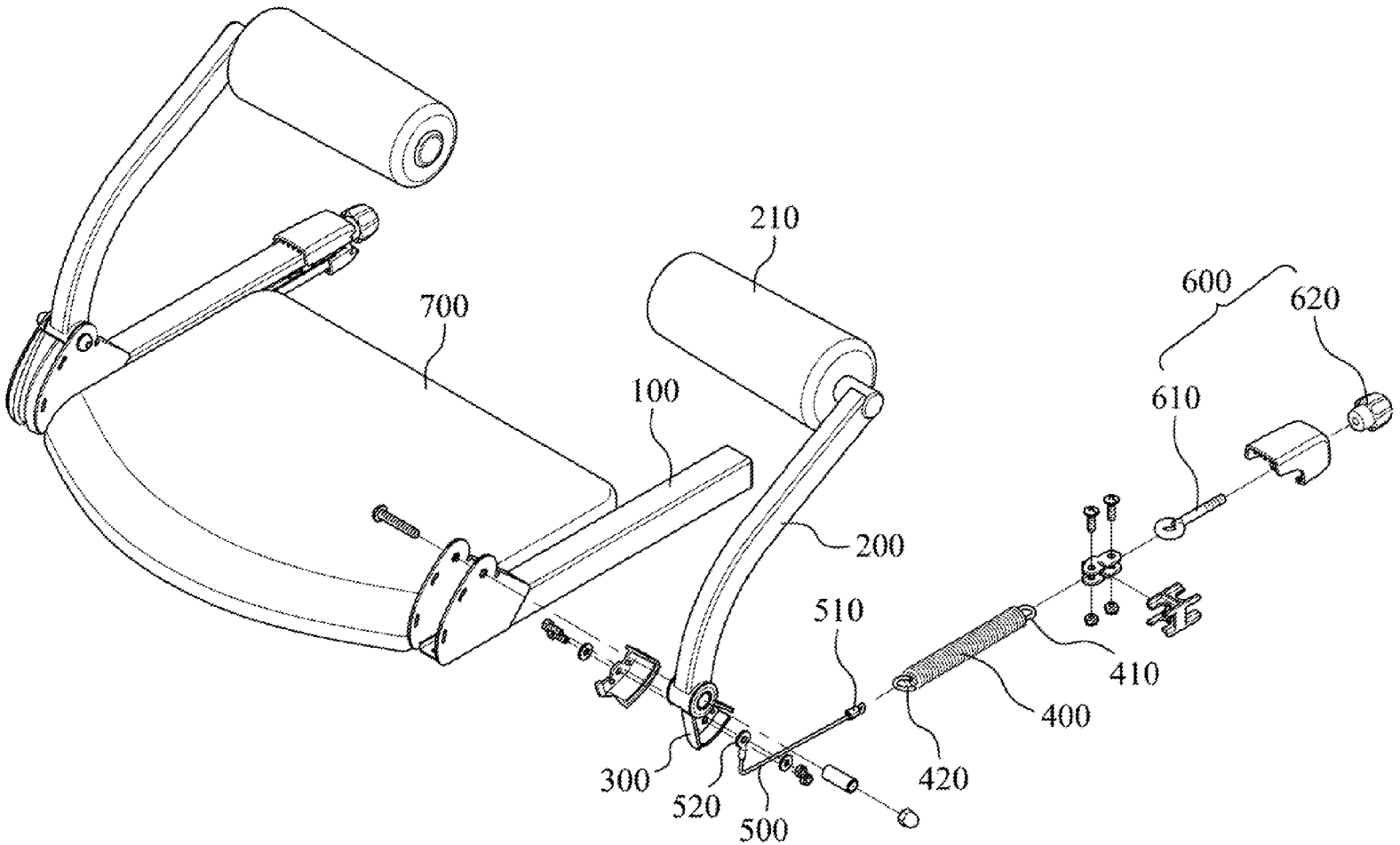
FIG. 1 is an exploded, perspective view of a fitness apparatus according to a first embodiment of this disclosure.

Reference will now be made in detail to the present embodiments of the disclosure, examples of which are illustrated in the accompanying drawings. Wherever possible, the same reference numbers are used in the drawings and the description to refer to the same or like parts.

First Embodiment

Figure 2:
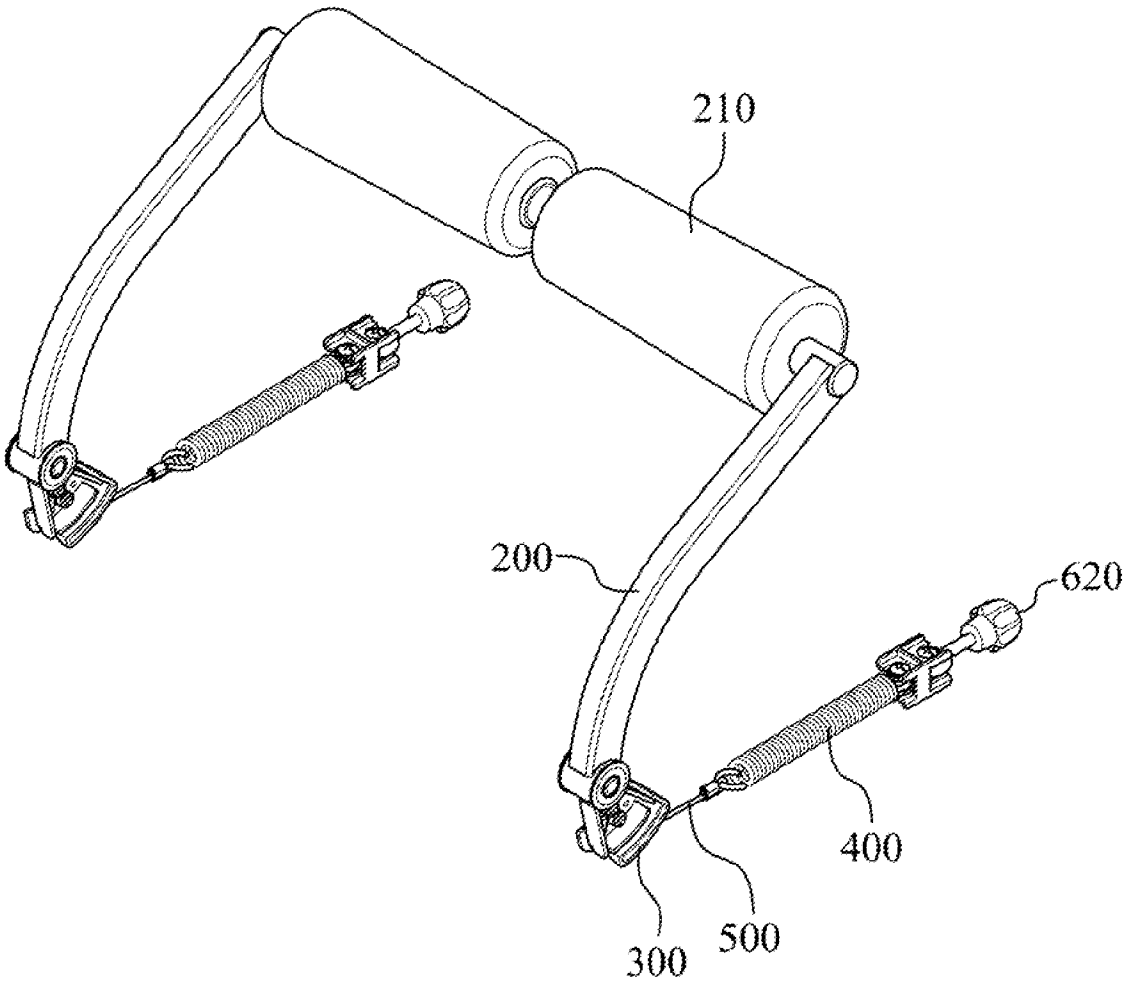
FIG. 2 is a perspective view of partial assembly of the fitness apparatus according to FIG. 1.
Figure 3:
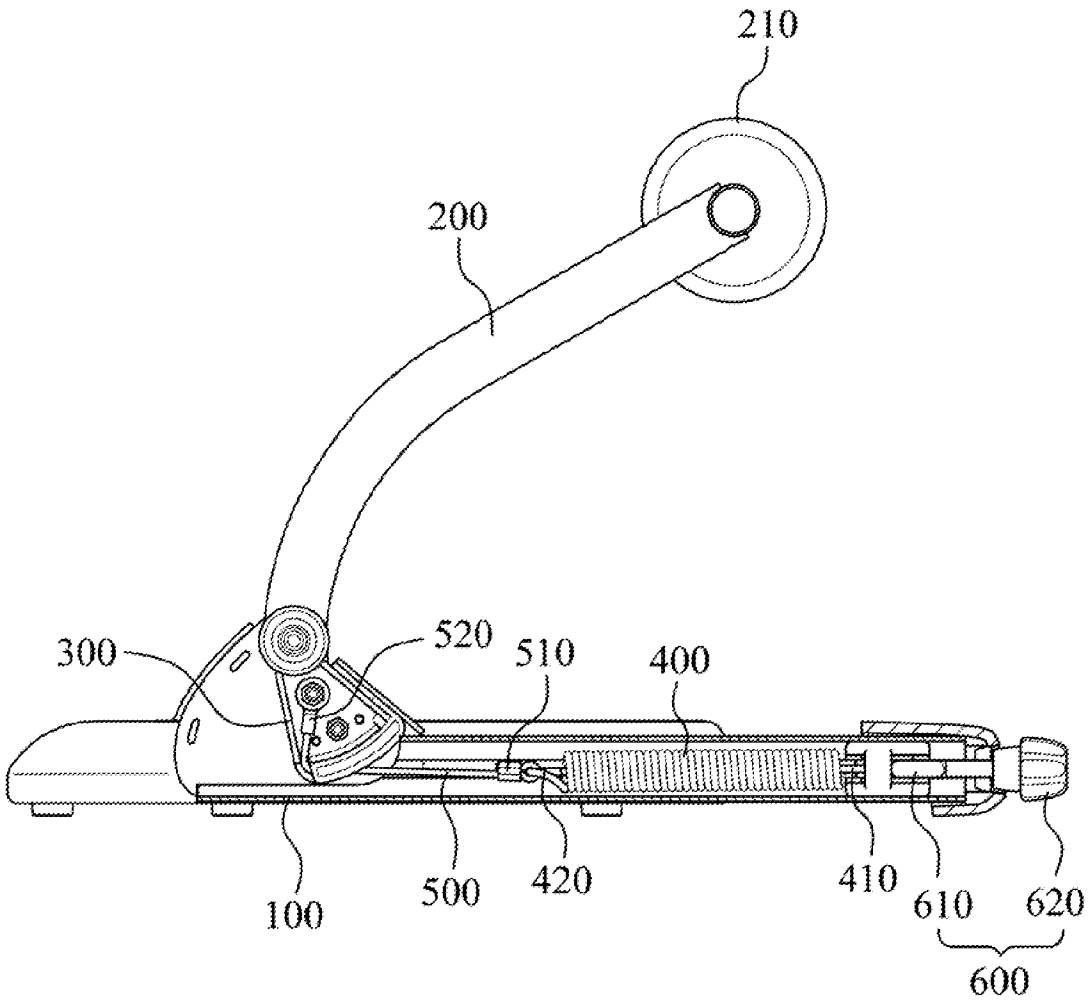
FIG. 3 is a partial cross-sectional view of the fitness apparatus according to FIG. 1.
Figure 4:
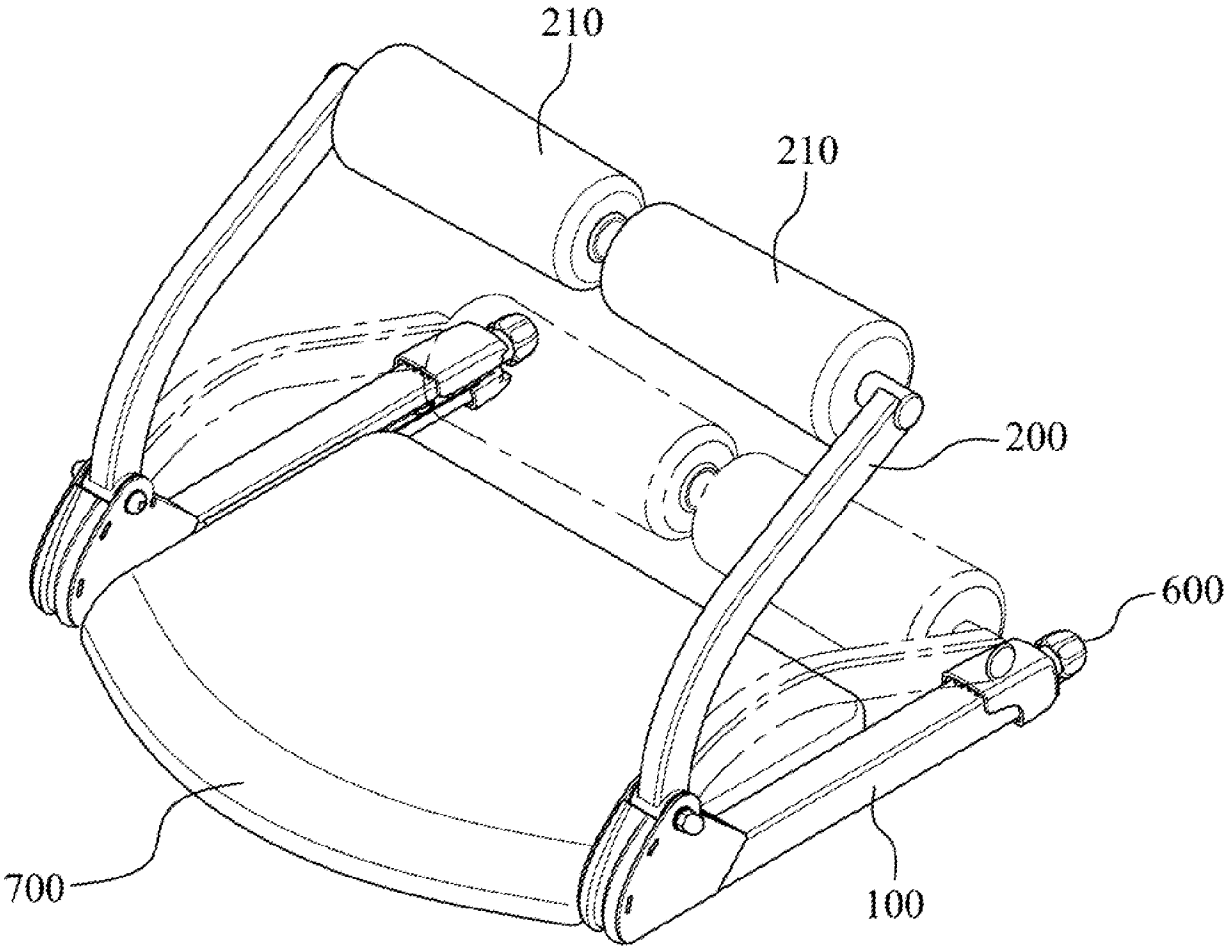
FIG. 4 shows how the fitness apparatus according to FIG. 1 motions.

FIG. 1 is an exploded, perspective view of a fitness apparatus according to a first embodiment of this disclosure. FIG. 2 is a perspective view of partial assembly of the fitness apparatus according to FIG. 1. FIG. 3 is a partial cross-sectional view of the fitness apparatus according to FIG. 1. And FIG. 4 shows how the fitness apparatus according to FIG. 1 motions.

Please refer to FIG. 1 first. The fitness apparatus includes a first frame 100, a second frame 200, a nose part 300, a linear elastic element 400, a cable 500, an adjusting module 600, and a seat 700. The second frame 200 is pivotally connected to the first frame 100. The nose part 300 and the second frame 200 are coaxially pivotally connected to the first frame 100. The nose part 300 and the second frame 200 can be structured as one-piece. The linear elastic element 400 has a first end 410 and a second end 420. The first end 410 can be connected to the first frame 100. The cable 500 has a connecting end 510 and a force-applying end 520. The connecting end 510 can be connected to the second end 420 of the linear elastic element 400. The cable 500 can be pressed against the nose part 300. The force-applying end 520 of the cable 500 can drive the second frame 200. When the second frame 200 pivotally swings against the first frame 100, the second frame 200 can pull the cable 500 and changes the length of the cable 500 pressed against the nose part 300. And the linear elastic element 400 can be stretched or shortened by the cable 500 as a result.

The first frame 100 can include an adjusting module 600. The linear elastic element 400 can be connected to the adjusting module 600. The adjusting module 600 can be configured to adjust the position of the first end 410 of the linear elastic element 400 relative to the first frame 100. The adjusting module 600 can include a threaded element 610 and a screw element 620. The threaded element 610 can be connected to and drives the first end 410 of the linear elastic element 400. The screw element 620 can be matched with the threaded element 610. The screw element 620 can be positioned at the first frame 100. The seat 700 can be connected to the first frame 100. The seat 700 is configured to carry a user's weight. The second frame 200 can include a pad 210. The pad 210 can be foam or buffer materials. A user can rest his/her back or body against the pad 210.

Please refer to FIG. 2 and FIG. 3, for more clearly illustrating the relationship among the second frame 200, the nose part 300, the cable 500, and the linear elastic element 400 of FIG. 1. The nose part 300 extends from the second frame 230 and motions with the second frame 200. Using the shape or mechanism of the nose part 300 against the cable 500 can transfer the swing of the second frame 200 relative to the first frame 100 to the linear pulling of the cable 500. The linear pulling of the cable 500 can drive the linear elastic element 400 stretching and shortening. Moreover, the adjusting module 600 can be used for adjusting the resilience force of the linear elastic element 400. The adjusting of the resilience force of the linear elastic element 400 is easy and convenient.

Please refer to FIG. 4, illustrating that the second frame 200 can swing to be close with the first frame 100, and then by the resilience force of the linear elastic element 400, the second frame 200 can swing back to the original position again. A user can sit on the seat 700, and rest his/her back on the pad 210, so that the fitness apparatus can assist sit-up exercises. A user can also lie prone on the fitness apparatus with his/her chest resting against the pad 210 and hands on the ground, so that the fitness apparatus can assist push-up exercises. A user can also sit on a chair (not shown), rest each foot on each of the two pad 210, so that the user can step down left foot and right foot alternatively or at the same time to make the second frame 200 swinging against the first frame 100, thus the fitness apparatus can assist the stepping exercise, or simulating the cycling strokes. A user can further lie on the side over the fitness apparatus to exercise, grasp the first frame 100 or the second frame 200 to exercise arms, or lift legs using the fitness apparatus. In such versatile manners, the fitness apparatus can assist many kinds of exercises and is not limited by the exampled above.

Second Embodiment

Figure 5:
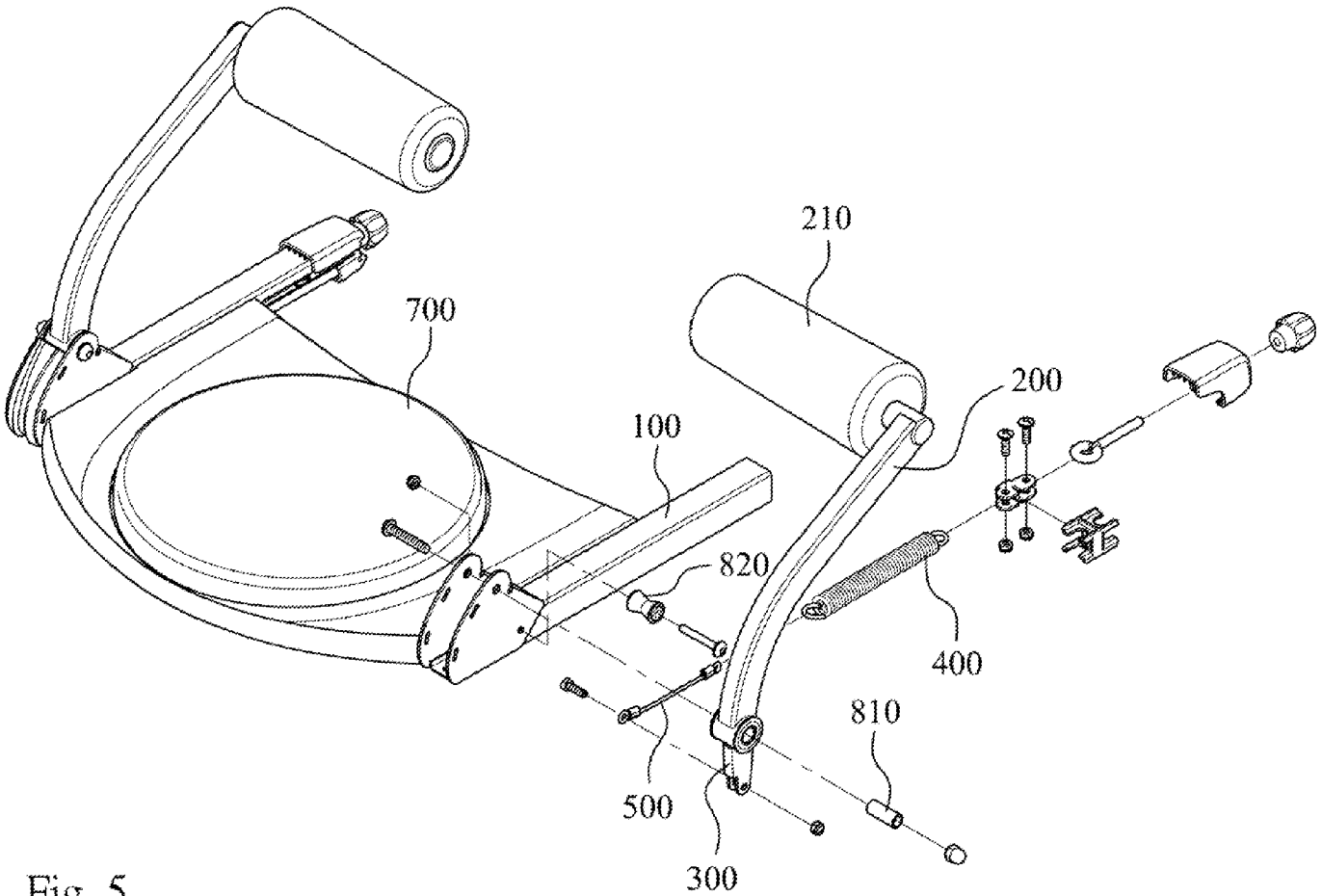
FIG. 5 is an exploded, perspective view of a fitness apparatus according to a second embodiment of this disclosure.
Figure 6:
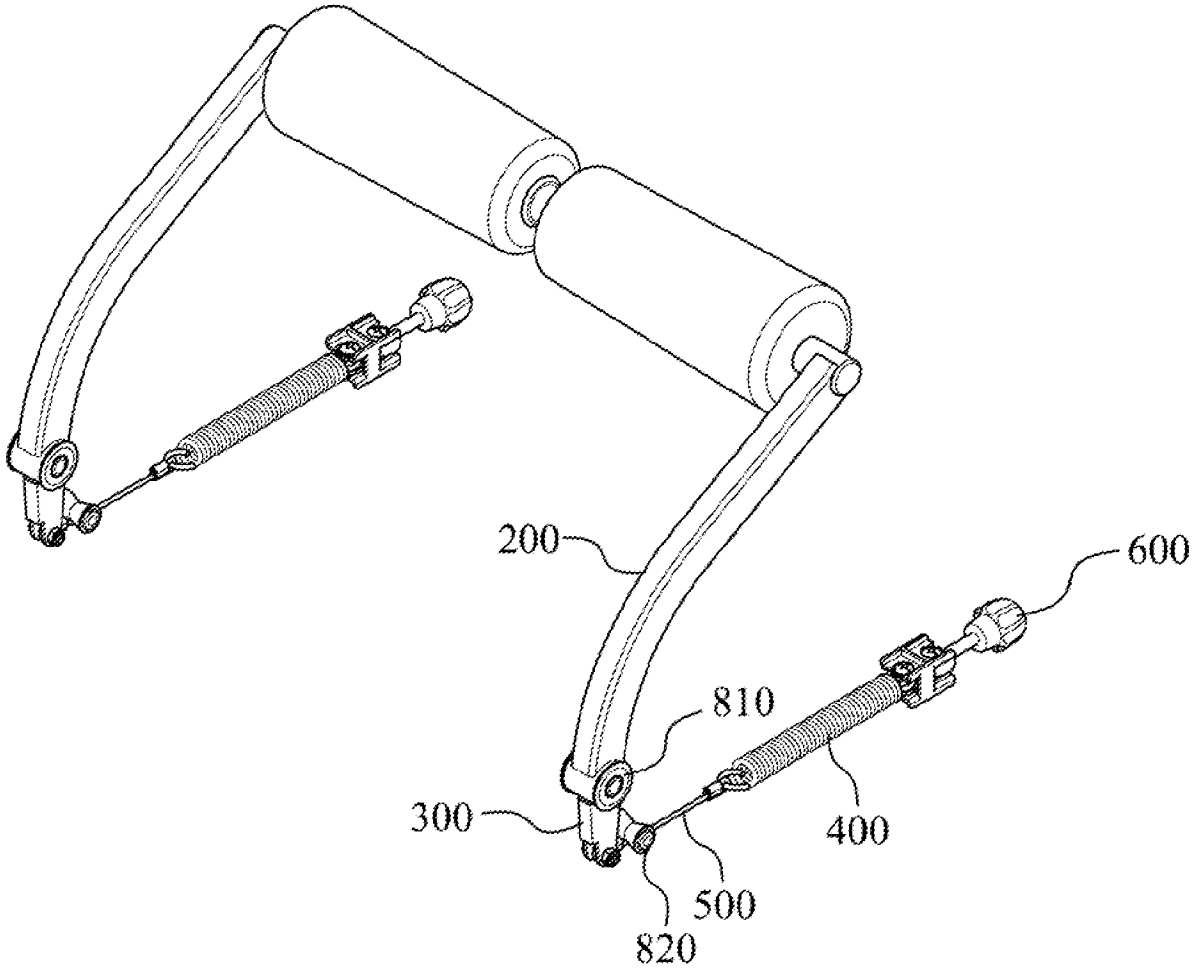
FIG. 6 is a perspective view of partial assembly of the fitness apparatus according to FIG. 5.

FIG. 5 is an exploded, perspective view of a fitness apparatus according to a second embodiment of this disclosure. And FIG. 6 is a perspective view of partial assembly of the fitness apparatus according to FIG. 5.

The appearance and operation between the second embodiment and the first embodiment are similar and need not be repeated again. The same reference numbers refer to the same or like parts. The major difference between the second and the first embodiment is mainly the pulley 810. The pulley 810 is pivotally connected to the first frame 100. The pulley 810 and the second frame 200 can be coaxially pivotally connected to the first frame 100. The second frame 200 can swing relative to the first frame 100 through the assistance of the pulley 810.

The fitness apparatus can further include a locating element 820. The locating element 820 is connected to the first frame 100 and is configured to limit the position of the cable 500. Accordingly, when the second frame 200 drives the cable 500 to pull the linear elastic element 400, the direction of the cable 500 pulling the linear elastic element 400 is coaxial with the linear elastic element 400. Therefore, the resilience force of the linear elastic element 400 can reset the position of the second frame 200 against the first frame 100.

Third Embodiment

Figure 7:
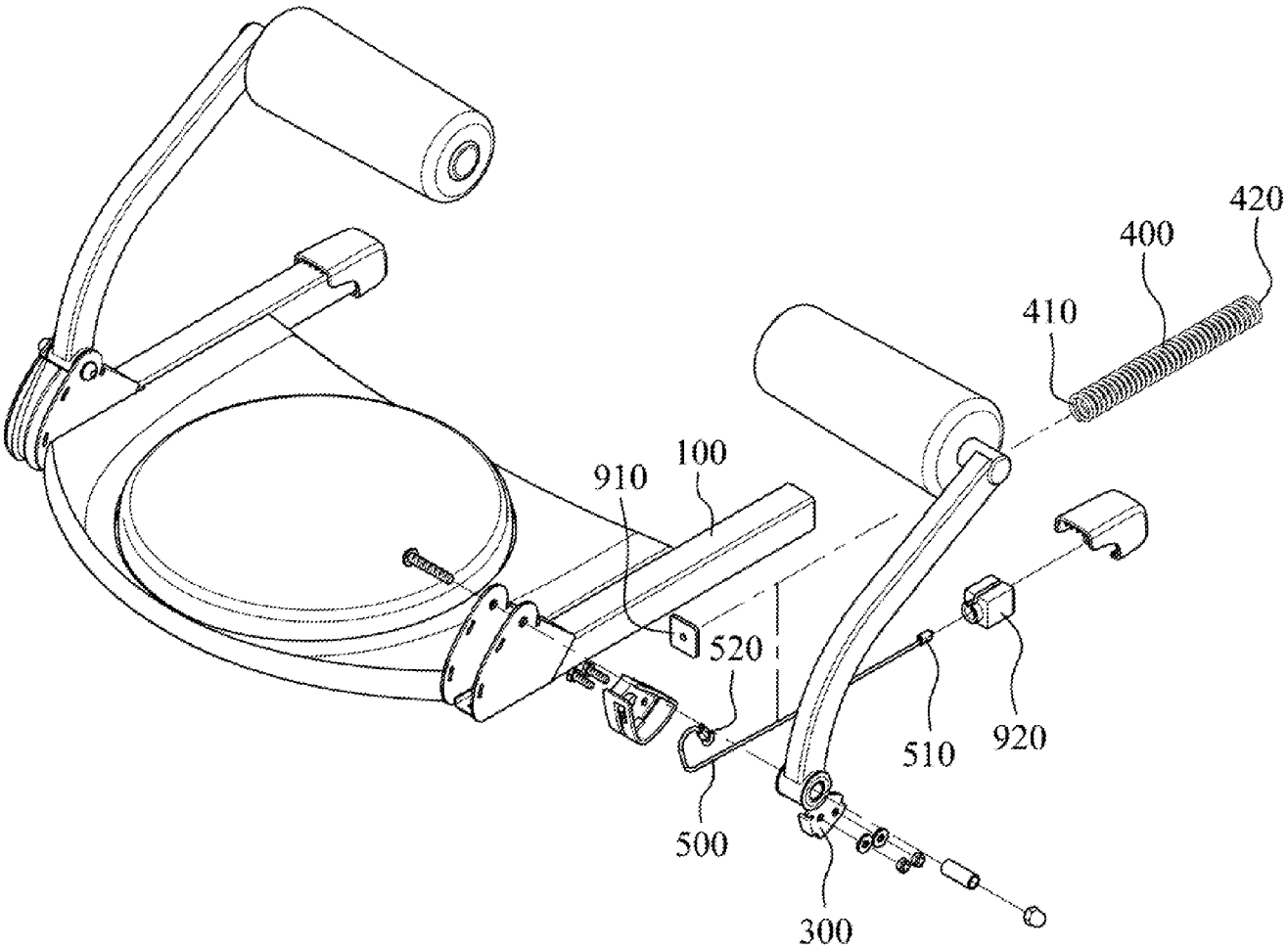
FIG. 7 is an exploded, perspective view of a fitness apparatus according to a third embodiment of this disclosure.
Figure 8:
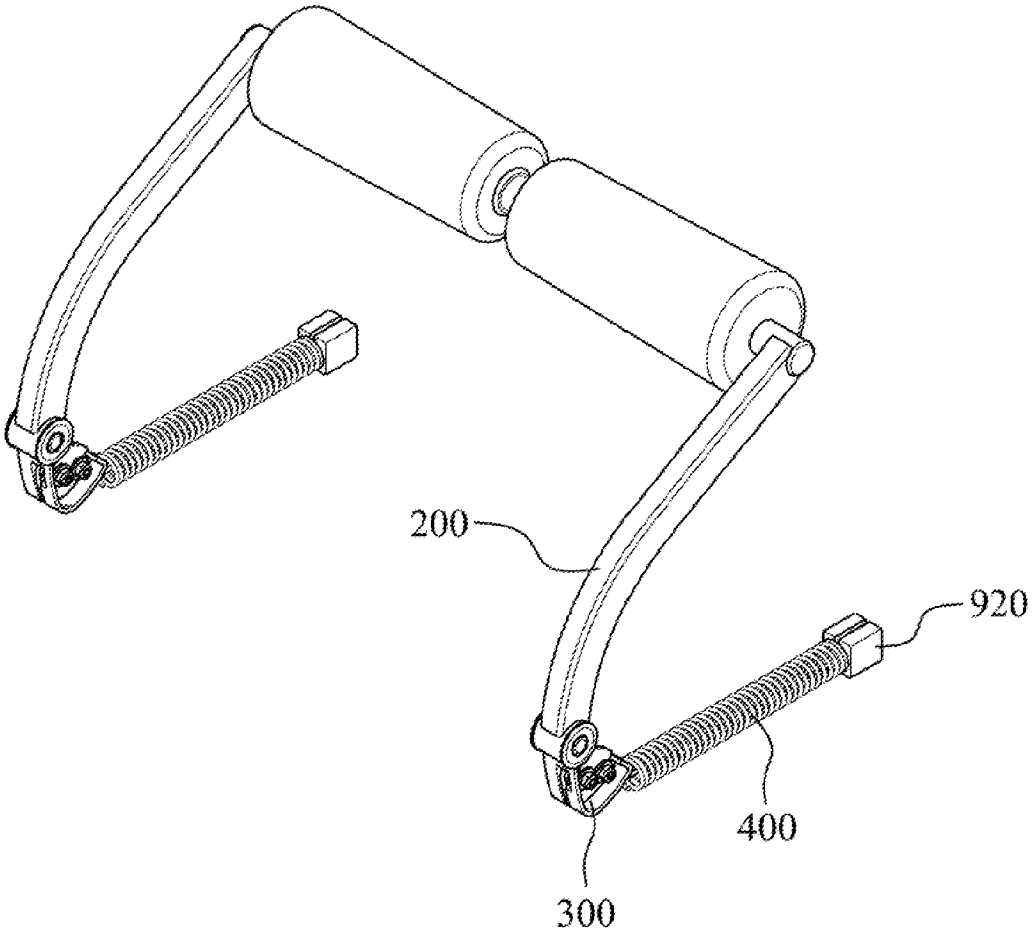
FIG. 8 is a perspective view of partial assembly of the fitness apparatus according to FIG. 7.
Figure 9:
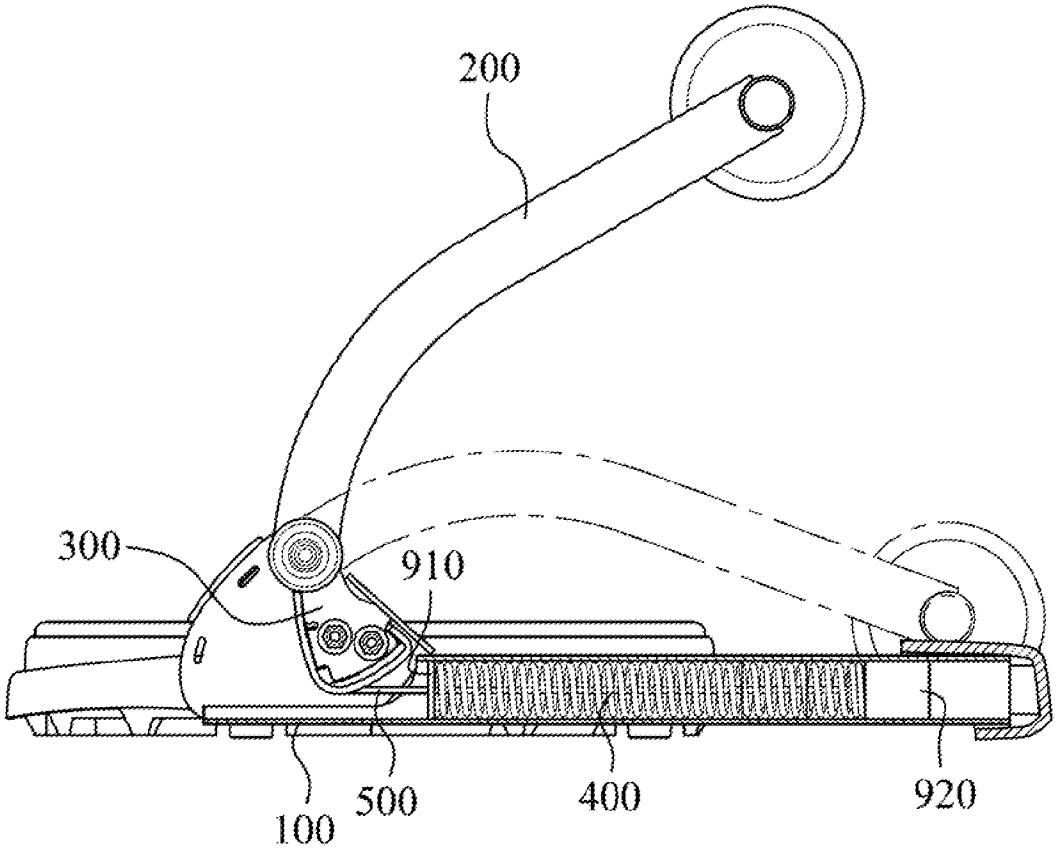
FIG. 9 is a partial cross-sectional view of the fitness apparatus according to FIG. 7.

FIG. 7 is an exploded, perspective view of a fitness apparatus according to a third embodiment of this disclosure. FIG. 8 is a perspective view of partial assembly of the fitness apparatus according to FIG. 7. And FIG. 9 is a partial cross-sectional view of the fitness apparatus according to FIG. 7.

The appearance and function between the third embodiment and the first embodiment are similar and need not be repeated again. The same reference numbers refer to the same or like parts. The major difference between the third and the first embodiment is mainly the application of the linear elastic element 400. The third embodiment makes use of the stretching-back force of the linear elastic element 400 as the resilience force to reset the position of the second frame 200 against the first frame 100, while the first embodiment makes use of the shortening-back force of the linear elastic element 400 as the resilience force to reset the position of the second frame 200 against the first frame 100. In the third embodiment, when the second frame 200 swings against the first frame 100, the second frame 200 drives the cable 500 to press and shorten the linear elastic element 400.

More specifically, the fitness apparatus includes a first frame 100, a second frame 200, a nose part 300, a linear elastic element 400, a cable 500, a blocking part 910, and a pushing element 920. The second frame 200 is pivotally connected to the first frame 100. The nose part 300 and the second frame 200 are coaxially pivotally connected to the first frame 100. The nose part 300 and the second frame 200 can be structured as one-piece. The blocking element 910 is connected to the first frame 100. A first end 410 of the linear elastic element 400 is located at the blocking element 910 to be connected to the first frame 100. So the blocking element 910 can be used for blocking the first end 410 of the linear elastic element 400. The pushing element 920 can be slidably connected to the first frame 100 along a stretching direction of the linear elastic element 400. The pushing element 920 pushes against a second end 420 of the linear elastic element 400. A connecting end 510 of the cable 500 is connected to the pushing element 920. Thus the cable 500 is connected to the second end 420 of the linear elastic element 400 through the pushing element 920. The cable 500 is pressed against the nose part 300. A force-applying end 520 of the cable 500 can drive the second frame 200. When the second frame 200 pivotally swings against the first frame 100, the second frame 200 can pull the cable 500 and thus changes the length of the cable 500 pressed against the nose part 300. Therefore the linear elastic element 400 can be shortened or stretched by the cable 500.

Fourth Embodiment

Figure 10:
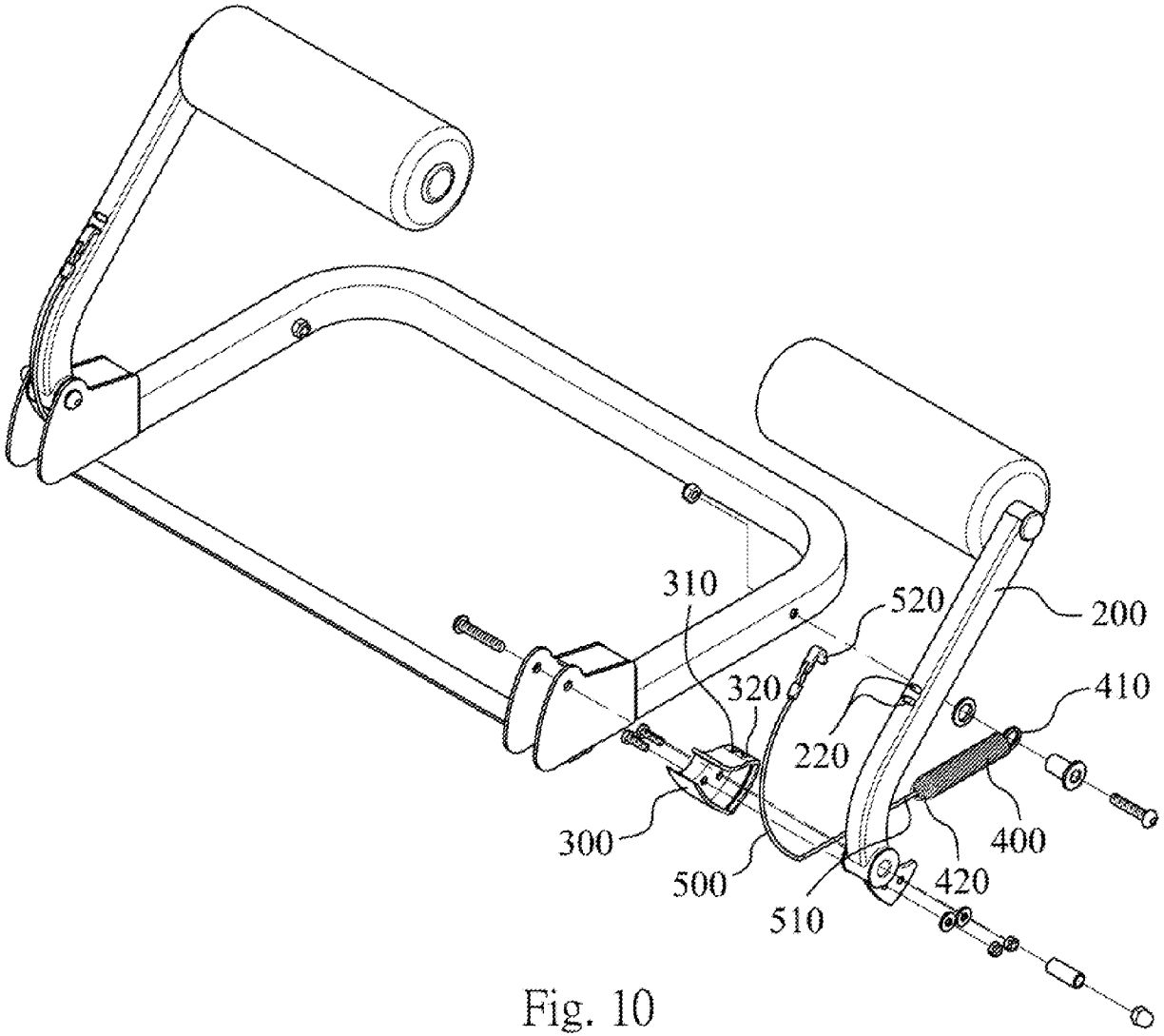
FIG. 10 is an exploded, perspective view of a fitness apparatus according to a fourth embodiment of this disclosure.
Figure 11:
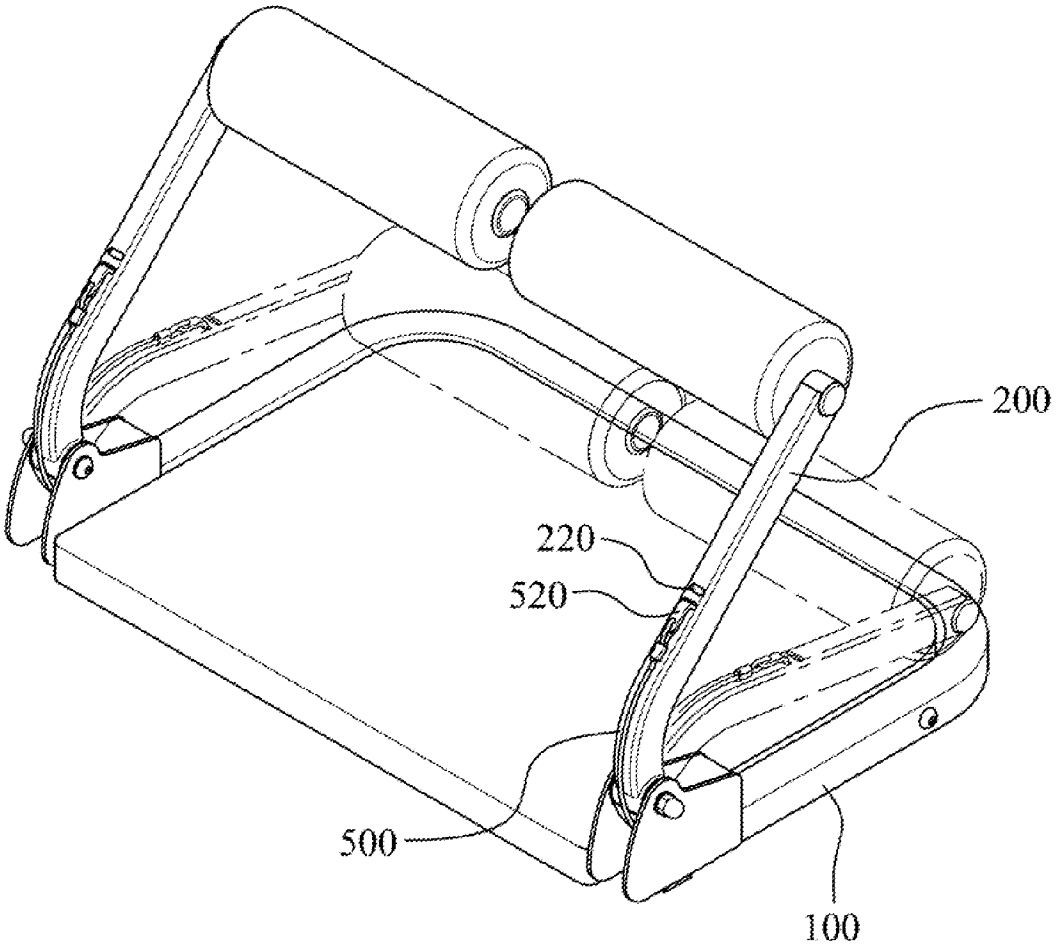
FIG. 11 shows how the fitness apparatus according to FIG. 10 motions.
Figure 12:
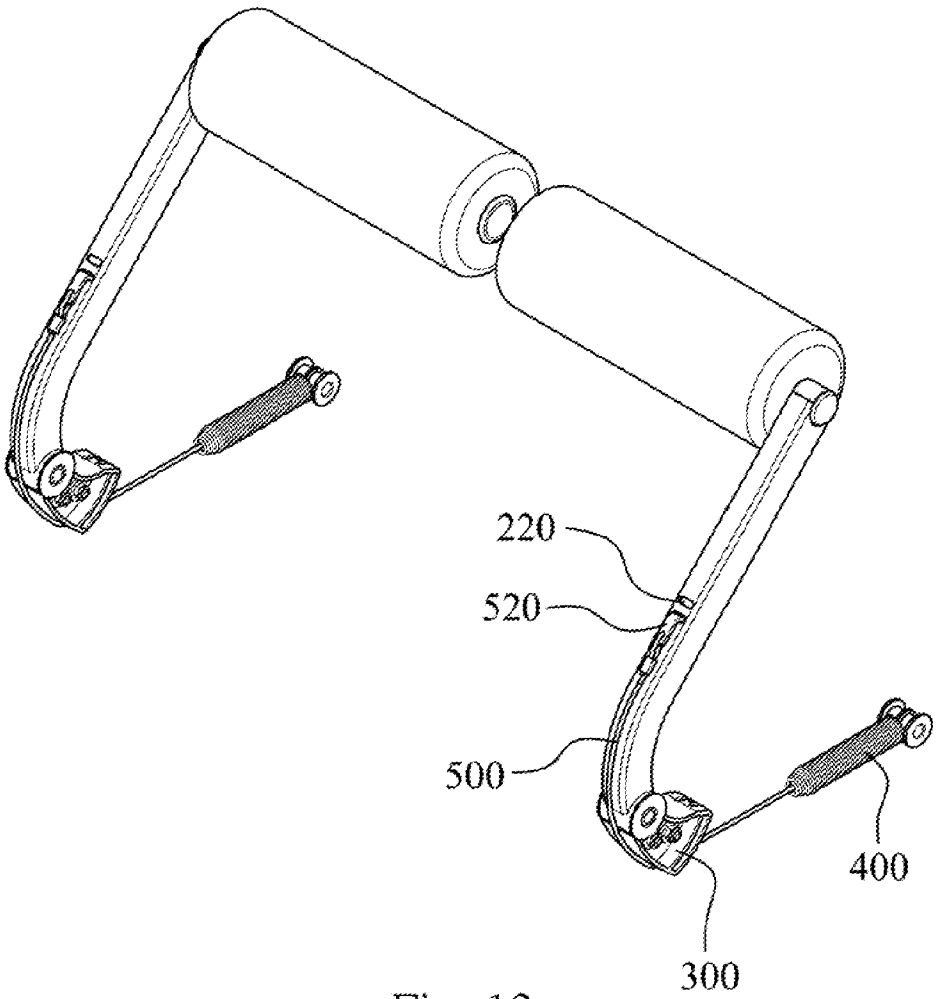
FIG. 12 is a perspective view of partial assembly of the fitness apparatus according to FIG. 10.
Figure 13:
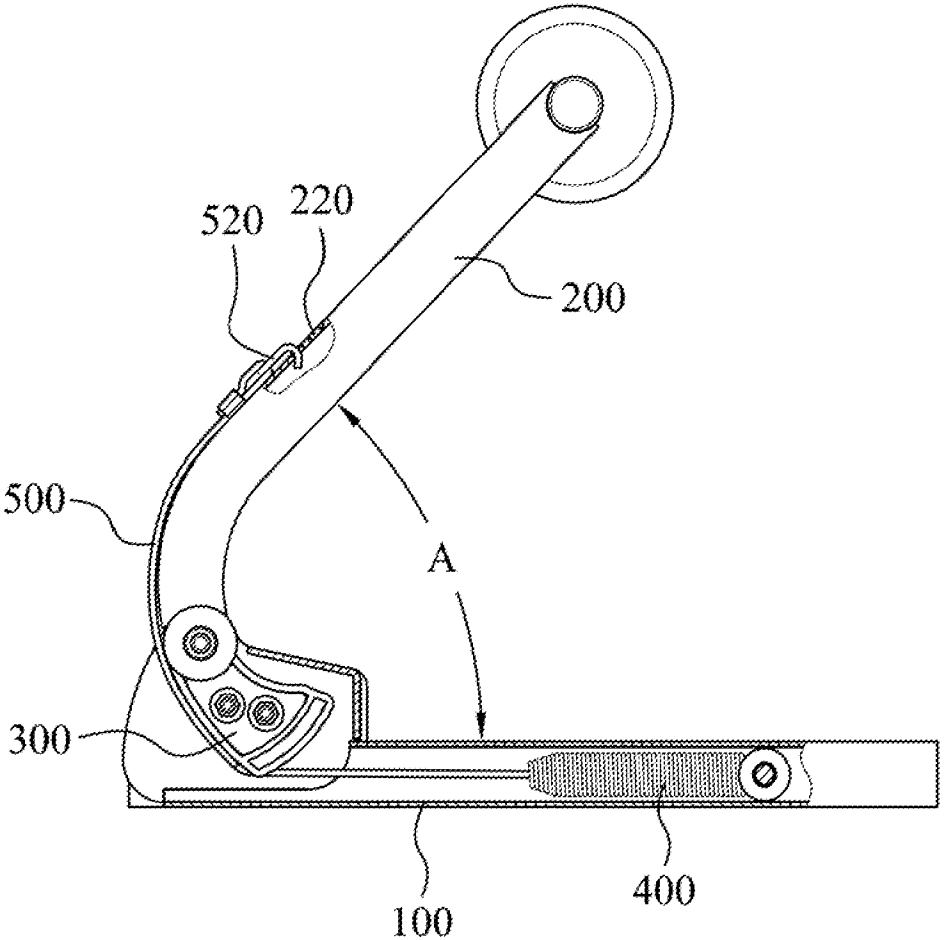
FIG. 13 is a partial cross-sectional view of the fitness apparatus according to FIG. 10.

FIG. 10 is an exploded, perspective view of a fitness apparatus according to a fourth embodiment of this disclosure. FIG. 11 shows how the fitness apparatus according to FIG. 10 motions. FIG. 12 is a perspective view of partial assembly of the fitness apparatus according to FIG. 10. And FIG. 13 is a partial cross-sectional view of the fitness apparatus according to FIG. 10.

The appearance and function between the fourth embodiment and the first embodiment are similar and need not be repeated again. The same reference numbers refer to the same or like parts. The major difference between the fourth and the first embodiment is mainly the force-applying end 520 of the cable 500 being removably connected to the second frame 200. So that the position of the cable 500 fixed to the second frame 200 can be adjusted by a user. As a result, a predetermined angle A between the second frame 200 and the first frame 100 can be adjusted.

More specifically, the fitness apparatus includes a first frame 100, a second frame 200, a nose part 300, a linear elastic element 400, and a cable 500. The second frame 200 is pivotally connected to the first frame 100. The second frame has a plurality of installing parts 220. The nose part 300 and the second frame 200 are coaxially pivotally connected to the first frame 100. The nose part 300 and the second frame 200 can be structured as one-piece. The linear elastic element 400 has a first end 410. The first end 410 can be connected to the first frame 100. The cable 500 has a connecting end 510. The connecting end 510 can be connected to a second end 420 of the linear elastic element 400. The cable 500 can be pressed against the nose part 300. A force-applying end 520 of the cable 500 is removably connected to one of the installing parts 220 of the second frame 200. The force-applying end 520 of the cable 500 can thus drive the second frame 200. When the second frame 200 pivotally swings against the first frame 100, the second frame 200 can pull the cable 500 and thus changes the length of the cable 500 pressed against the nose part 300. And the linear elastic element 400 can be stretched by the cable 500 as a result. By connecting the force-applying end 520 of the cable 500 to different installing parts 220 of the second frame 200, the predetermined angle A between the second frame 200 and the first frame 100 can be changed. As a result, a user can adjust the predetermined angle A according to his/her own wish and need.

Figure 14:
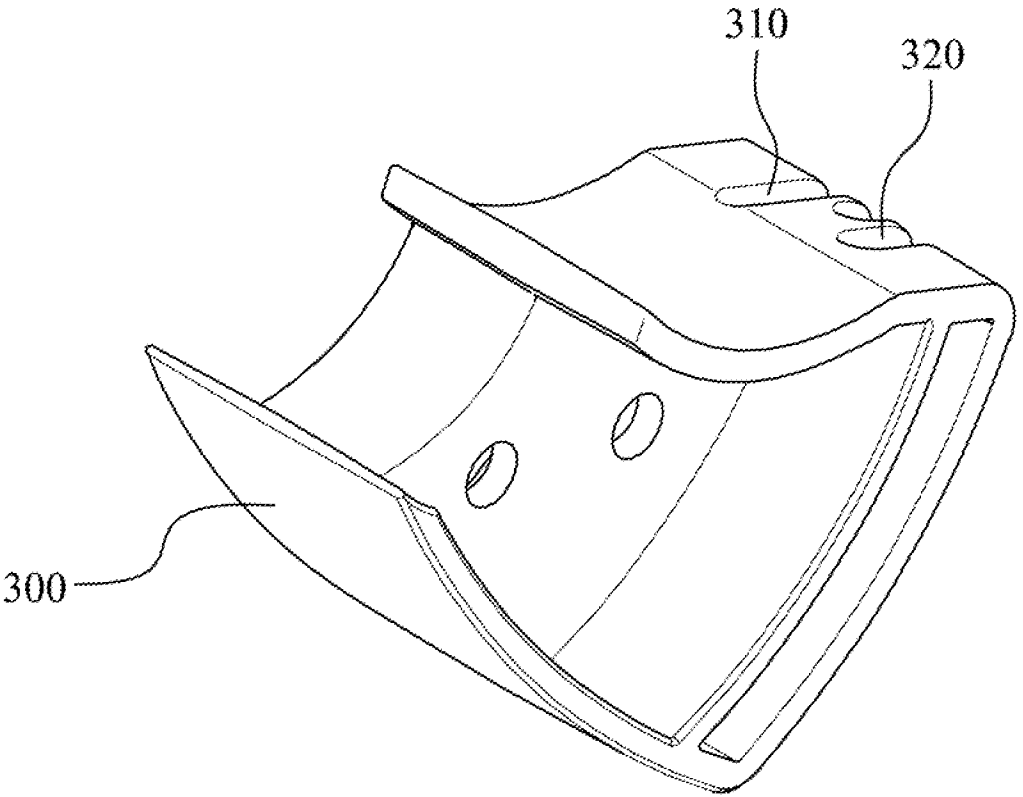
FIG. 14 is an enlarged perspective view of the nose part of the fitness apparatus according to FIG. 10.

FIG. 14 further shows an enlarged perspective view of the nose part 300 of the fitness apparatus according to FIG. 10. The nose part 300 has guide parts 310 and 320. The guide parts 310 and 320 are both configured to guide and limit the cable 500. That is to say, the cable 500 can press against the guide part 310 or the guide part 320. The length of the cable 500 pressed against the guide part 310 is different from the length of the cable 500 pressed against the guide part 320. For instance, the distance between the guide part 310 and the pivot of the second frame 200 swinging against the first frame 100 is different from the distance between the guide part 320 and the pivot of the second frame 200 swinging against the first frame 100. Therefore, the arm of force lever of pulling the linear elastic element 400 can be different between pressing against the guide parts 310 and 320. Thus when the second frame 200 pivotally swings against the first frame 100, the elongation of the linear elastic element 400 pulling by the cable 500 can be different between pressing against the guide parts 310 and 320. A user can accordingly select from more predetermined resilience forces for resetting the position of the second frame 200 against the first frame 100.

Fifth Embodiment

Figure 15:
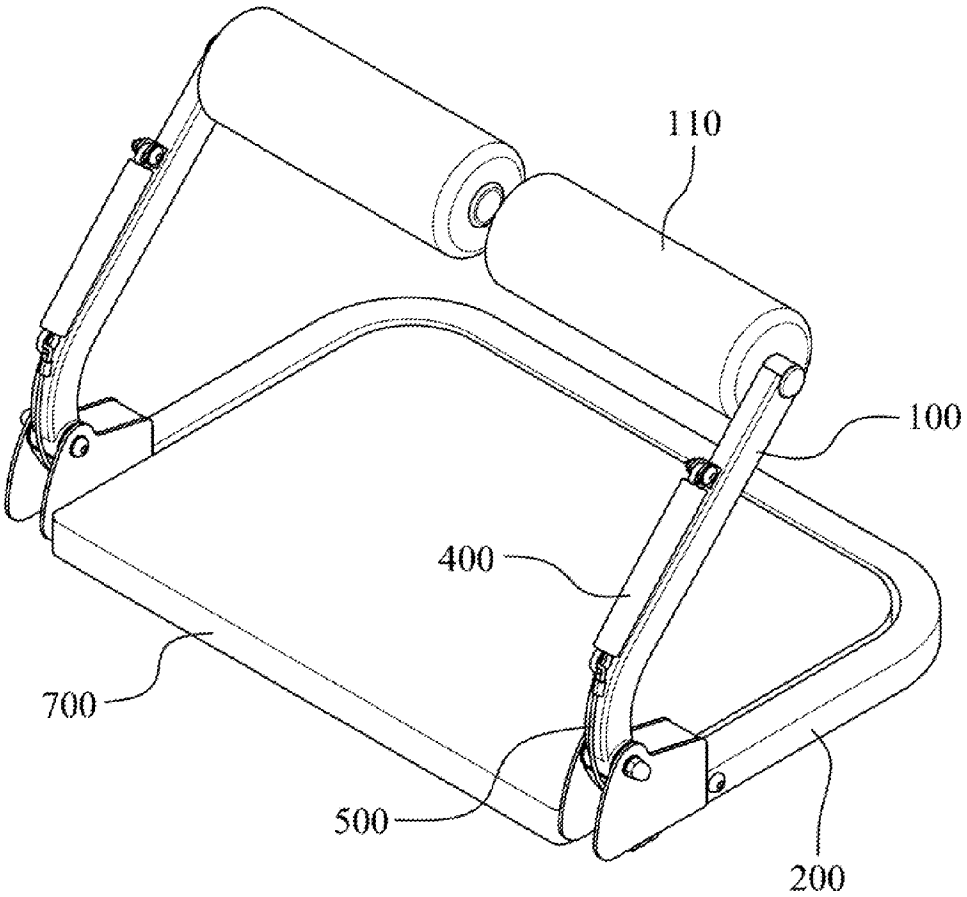
FIG. 15 is a perspective view of a fitness apparatus according to a fifth embodiment of this disclosure.
Figure 16:
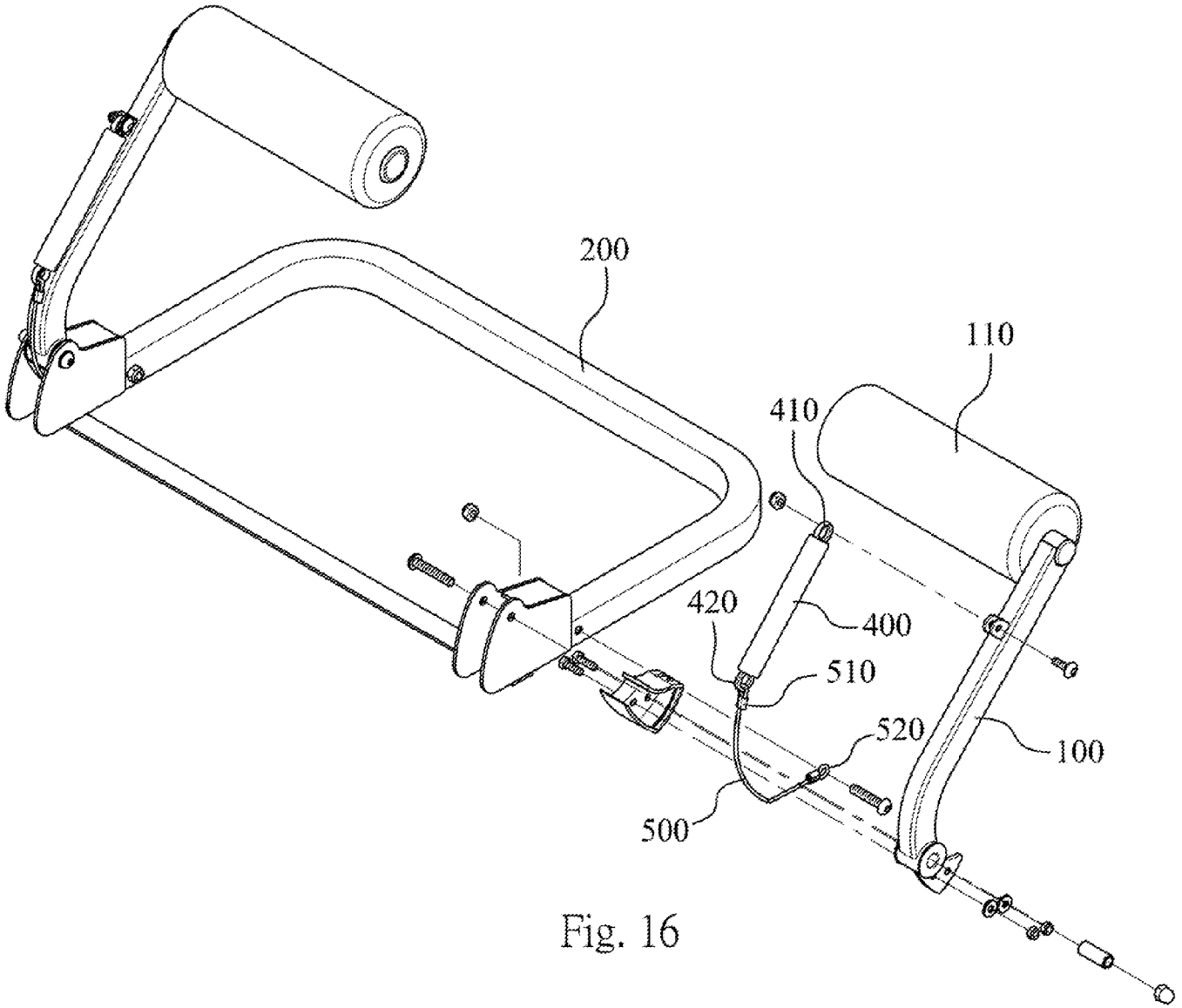
FIG. 16 is an exploded view of the fitness apparatus according FIG. 15.
Figure 17:
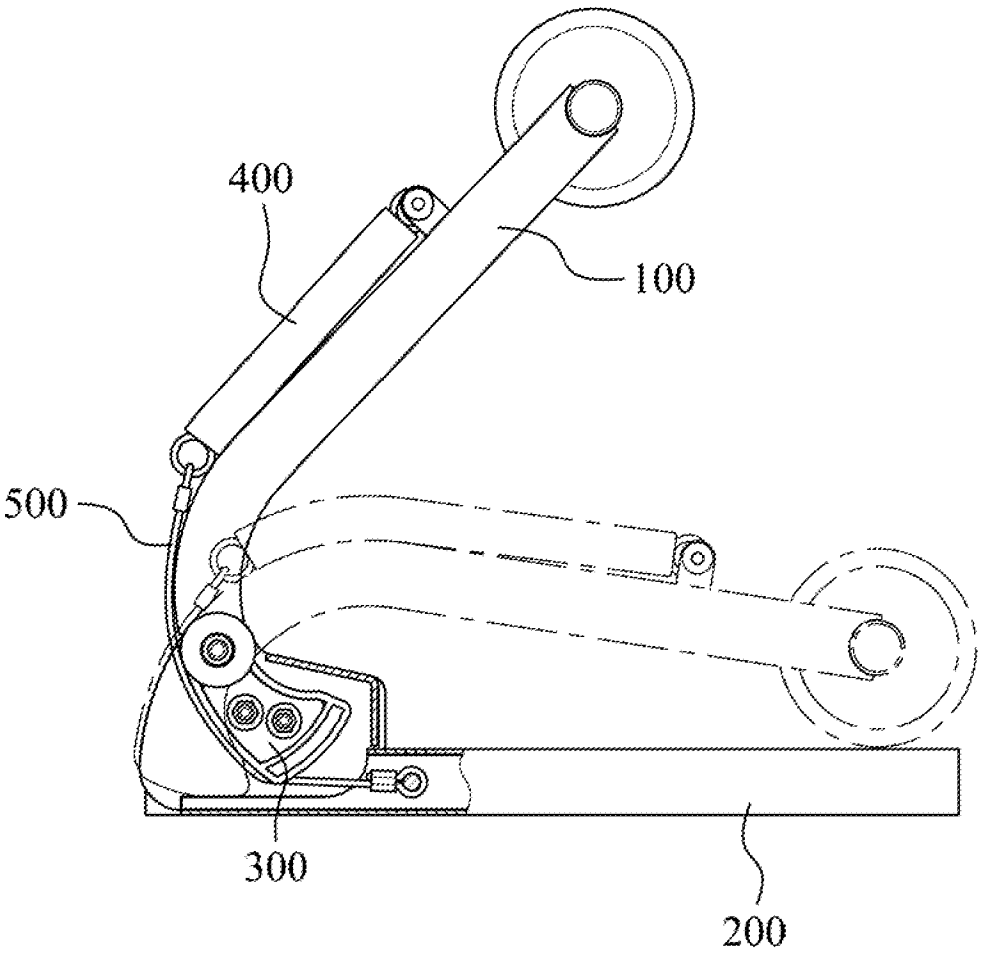
FIG. 17 shows how the fitness apparatus according to FIG. 15 motions.

FIG. 15 is a perspective view of a fitness apparatus according to a fifth embodiment of this disclosure. FIG. 16 is an exploded view of the fitness apparatus according FIG. 15. And FIG. 17 shows how the fitness apparatus according to FIG. 15 motions.

The appearance and function between the fifth embodiment and the first embodiment are similar and need not be repeated again. The same reference numbers refer to the same or like parts. The major differences between the fifth and the first embodiment are as follows. The linear elastic element 400 can be connected to the first frame 100. The seat 700 can be connected to the second frame 200. The first frame 100 can include a pad 110 for user resting his/her back or body. The pad 110 can be foam or buffer materials.

More specifically, the fitness apparatus includes a first frame 100, a second frame 200, a nose part 300, a linear elastic element 400, a cable 500, and a seat 700. The second frame 200 is pivotally connected to the first frame 100. The first frame 100 can include a pad 110. The pad 110 can be foam or buffer materials. A user can rest his/her back or body against the pad 110. The nose part 300 and the first frame 100 are coaxially pivotally connected to the second frame 200. The nose part 300 and the first frame 100 can be structured as one-piece. The linear elastic element 400 has a first end 410. The first end 410 can be connected to the first frame 100. The cable 500 has a connecting end 510. The connecting end 510 can be connected to a second end 420 of the linear elastic element 400. The cable 500 can be pressed against the nose part 300. A force-applying end 520 of the cable 500 can drive the second frame 200. When the second frame 200 pivotally swings against the first frame 100, the second frame 200 can pull the cable 500 and thus changes the length of the cable 500 pressed against the nose part 300. And the linear elastic element 400 can be stretched or shortened by the cable 500 as a result.

All embodiments mentioned above can further includes an adjusting module 600, as shown in FIG. 1, for adjusting the resilience force of the linear elastic element 400. Moreover, the linear elastic element 400 can be a linear spring, a hydraulic spring, a rubber spring, or a suspension block. All embodiments mentioned above can also adopt a pulley 810, as shown in FIG. 5, connected at the pivot between the first frame 100 and the second frame 200.

Furthermore, all embodiments mentioned above can be designed as the linear elastic element 400 being stretched or shorted when the second frame 200 is forced to be close to the first frame 100. And respectively, using, the elongation or the compression of the linear elastic element 400 to reset the position of the second frame 200 relative to the first frame 100.

Furthermore, in all embodiments mentioned above, the nose part 300 can be structured as one-piece with the first frame 100 or the second frame 200. The nose part 300 can include at least one guide part 310 or guide part 320, as shown in FIG. 14, to guide and limit the cable 500, in each embodiment. Different guide parts can be used for change the arm of force lever of pulling the linear elastic element 400.

In all embodiments mentioned above, the second frame 200 or the first frame 100 can include at least one installing part 220, as shown in FIG. 10-13, configured to install the force-applying end 520 of the cable 500. Different installing parts can be used for changing the predetermined angle A between the second frame 200 and the first frame 100.

All embodiments mentioned above can also include a seat 700. The seat 700 can be connected to the first frame 100 or the second frame 200, configured to carry the user's weight.

Furthermore, the second frame 200 in every embodiment mentioned above can be is in approximately inverted U shape. Or the fitness apparatus can include two second frames 200, each in approximately L shape. So that each second frame 200 can independently pivotally swing against the first frame 100, assisting a user doing arms or legs alternate exercise.

And in all embodiments mentioned above, the linear elastic element 400 can be connected to either the first frame 100 or the second 200, applying corresponding mechanism design, depending on the design purpose.

To sum up, the features from every embodiment mentioned above can be mixed to produce a fitness apparatus that meets need.

According to the foregoing embodiments and examples, the advantages of the present disclosure are described as follows.

1. Adopting a linear elastic element to achieve adjusting the resilience force for clamping-and-releasing. A linear elastic element is easy to design, easy to adjust, and easy to produce.

2. Providing an adjusting module to adjust the resilience force of the linear elastic element. The needs of users in different strength level and with different training purpose can all be met.

3. The predetermined angle between the first frame and the second frame can be adjusted. Again, the needs of users in different strength level and with different training purpose can all be met.

4. Be able to assist multiple exercises. Single fitness apparatus can achieve assisting multiple varies exercises, thus storage space can be saved and be efficient.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A fitness apparatus, comprising:

a first frame;

a second frame pivotally connected to the first frame;

a nose part, wherein the nose part and the second frame are coaxially pivotally connected to the first frame;

a linear elastic element having a first end and a second end, wherein the first end is connected to the first frame;

a cable having a connecting end and a force-applying end, wherein the connecting end is connected to the second end of the linear elastic element, the cable is pressed against the nose part, and the force-applying end of the cable drives the second frame; and a seat for a user to sit or lie connected to the first frame or the second frame;

wherein when the second frame pivotally swings against the first frame, the second frame pulls the cable and changes a length of the cable pressed against the nose part, whereby the linear elastic element is stretched or shortened by the cable.

2. The fitness apparatus of claim 1, wherein the nose part and the second frame are structured as one-piece.

3. The fitness apparatus of claim 1, wherein the first frame comprises an adjusting module, the linear elastic element is connected to the adjusting module, and the adjusting module is configured to adjust the position of the first end of the linear elastic element.

4. The fitness apparatus of claim 3, wherein the adjusting module comprises:

a threaded element connected to the first end of the linear elastic element, whereby the threaded element drives the first end; and a screw element matched with the threaded element, wherein the screw element is positioned at the first frame.

5. The fitness apparatus of claim 1, further comprising:

a pulley pivotally connected to the first frame, wherein the second frame and the pulley are coaxially pivotally connected to the first frame.

6. The fitness apparatus of claim 1, wherein the first frame comprises:

a blocking element configured to block the first end of the linear elastic element; and a pushing element slidably connected to the first frame along a stretching direction of the linear elastic element, wherein the pushing element pushes against the second end of the linear elastic element, and the connecting end of the cable connects the second end of the linear elastic element through the pushing element.

7. The fitness apparatus of claim 1, wherein the force-applying end of the cable is removably connected to the second frame.

8. The fitness apparatus of claim 7, wherein the nose part and the second frame are structured as one-piece.

9. The fitness apparatus of claim 7, wherein the nose part has a guide part, and the guide part guides and limits the cable.

10. The fitness apparatus of claim 7, wherein the nose part has a plurality of guide parts, each of the plurality of guide parts is configured to guide and limit the cable, and the length of the cable pressed against each of the plurality of the guide parts is different.

11. The fitness apparatus of claim 7, wherein the second frame has a plurality of installing parts configured to fix the force-applying end of the cable to different locations of the second frame.

12. The fitness apparatus of claim 7, further comprising:

a pulley pivotally connected to the first frame, wherein the second frame and the pulley are coaxially pivotally connected to the first frame.

13. The fitness apparatus of claim 7, wherein the first frame comprises:

a blocking element configured to block the first end of the linear elastic element; and a pushing element slidably connected to the first frame along a stretching direction of the linear elastic element, wherein the pushing element pushes against the second end of the linear elastic element, and the connecting end of the cable connects the second end of the linear elastic element through the pushing element.

14. The fitness apparatus of claim 1, wherein the second frame is in an inverted U shape.

15. The fitness apparatus of claim 1, further comprising another second frames pivotally connected to the first frame, wherein the two second frames are independent from each other, and each of the two second frames is in an L shape.

* * * * *